United States Patent [19]

Gijrath et al.

[11] 4,358,702

[45] Nov. 9, 1982

[54] COLOR TUBE SHADOW MASK MOUNT

[75] Inventors: Johannes H. N. Gijrath; Albertus A. M. Van Liempd; Hendrik S. A. Versteegen; Josephus J. Van Der Geer; Henricus J. M. Van Der Avoort, all of Eindhoven, Netherlands

[73] Assignee: U.S. Philips Corporation, New York, N.Y.

[21] Appl. No.: 198,899

[22] Filed: Oct. 20, 1980

[30] Foreign Application Priority Data

Jul. 21, 1980 [NL] Netherlands ..... 8004174

[51] Int. Cl.[3] ..... H01J 29/07

[52] U.S. Cl. ..... 313/404; 313/406

[58] Field of Search ..... 313/404, 406, 405

[56] References Cited

U.S. PATENT DOCUMENTS 3,548,235 12/1970 Driedijk et al. ..... 313/404

4,300,071 11/1981 Dougherty et al. ..... 313/406 X

*Primary Examiner*—Robert Segal

*Attorney, Agent, or Firm*—Robert J. Kraus

[57] ABSTRACT

A color selection electrode (7) is suspended in the corners of the upright edge (3) of the display window (2) by means of strip-shaped resilient elements (25) which extend substantially perpendicularly to the electron beams deflected towards the respective corner of the display window. The resilient elements (25), at their ends remote from the color selection electrode (7), comprise a peg (27) the axis of which extends substantially parallel to the direction of the electron beams directed towards the respective corner. In the corner of the upright edge (3) of the display window (2) a supporting element (30) is connected which comprises a portion (32) which is provided with an aperture (33), which portion (32) extends substantially perpendicularly to the axis of the peg (27). The pegs (27) fall partly through the apertures (33). A screening cap for screening the electron beams from the earth's magnetic field in the sleeve is connected to the supporting element (30) thus exerting no pressure on the resilient elements (25).

10 Claims, 12 Drawing Figures

COLOR TUBE SHADOW MASK MOUNT

BACKGROUND OF THE INVENTION

The invention relates to a colour display tube comprising an envelope having a substantially rectangular display window provided with an upright edge and a substantially rectangular colour selection electrode having a large number of apertures, which electrode is suspended in the corners of the display window by means of a strip-shaped resilient element connected to each corner of the colour selection electrode, which resilient element is substantially perpendicular to the direction of electron beams deflected towards the relevant corner of the display window, and which resilient element has a peg at its end remote from the colour selection electrode.

Such a colour display tube is disclosed in Netherlands Patent Application No. 6701 585 to which British Pat. No. 1,189,403 corresponds. The strip-shaped resilient elements connected to the corners of the colour selection electrode ensure that in the case of expansion the colour selection electrode moves towards the display window. The strip-shaped resilient elements have a peg at their end remote from the colour selection electrode. Conical holes are drilled in the corner of the upright edge of the display window. The colour selection electrode is suspended in the display window by placing the pegs in the conical holes.

However, in order to obtain a good resistance to shocks, it is necessary for the resilient elements in such a tube to exert a large pressure on the holes in the edge of the display window, since otherwise the pegs work loose from the holes. In colour selection electrodes which do not comprise a rigid carrier frame, however, this results in deformations of the colour selection electrode at the usual temperature treatment to which the tubes are subjected during the manufacture. Moreover, the drilling of holes in the upright edge of the display window gives an increased possibility of fracture during the manufacture of the tube.

It therefore an object of the invention to provide a suspension of a colour selection electrode in a colour display tube which has a large resistance to shocks.

Another object of the invention is to provide a suspension of a colour selection electrode in a display tube with which possibility of fracture of the tube is considerably reduced.

A further object of the invention is to provide a suspension of an internal conical screening cap which is adapted to the suspension of the colour selection electrode.

According to the invention, a colour display tube of a kind mentioned in the opening paragraph is characterized in that the axis of the peg extends substantially parallel to the direction of the electron beams directed towards the relevant corner, which peg comprises a conical portion, and that in the corner of the upright edge of the display window a supporting element is connected, which supporting element comprises a portion extending perpendicularly to the axis of the peg, which portion comprises an aperture and through which aperture the conical portion of the peg falls partly. Since the axis of the peg is perpendicular to the resilient element and the supporting element comprises a portion extending perpendicularly to the axis, the peg always extends equally far through the aperture in the supporting element. The resilient elements only exert a very small pressure on the supporting elements. As a result of the position of the peg and the portion of the supporting element with the aperture, the colour selection electrode can be dis-assembled and assembled again in a simple manner. The aperture in the supporting element is preferably a triangular aperture. Herewith it is achieved that the conical portion of the peg engages the edges of the aperture in a reproducible manner.

A further embodiment is characterized in that at its end remote from the strip-shaped resilient element the peg has a locking hook extending towards the colour selection electrode. In the case of shocks perpendicular to the display window in a direction away from the display window, the peg locks itself in the aperture of the supporting element. When shocks occur perpendicularly to the display window in a direction towards the display window, the forces on the peg are such that the peg works loose from the aperture. In order to prevent the colour selection electrode from working loose when such shocks occur, the peg comprises a locking hook which extends towards the colour selection electrode.

Still a further embodiment is characterized in that for at least one strip-shaped resilient element the peg forms part of a metal plate which is connected to the end of the strip-shaped resilient element remote from the colour selection electrode. In order to ensure that the colour selection electrode is not deformed in the assembled condition, the position of the pegs should correspond accurately to the position of the apertures in the supporting elements. In principle, three resilient elements can directly be provided with a peg and be placed with the pegs in the relevant apertures in the supporting elements. As a result of this the position of the fourth peg is fixed. By means of a separate metal plate comprising a peg the position of the fourth peg is adapted to the position of the aperture in the fourth supporting element. Plates provided with a peg are preferably secured to three or four resilient elements. Herewith it is effected that each time two resilient elements situated at a diagonal opposite to each other engage with the pegs the edges of the apertures in the supporting element at the same clamping pressure.

Again a further embodiment is characterized in that the supporting element has at least one projection, which projection is sealed in the upright edge of the display window. The projections are sealed in the upright edge of the display window at right angles or obliquely whether or not provided already with the portion of the supporting element which extends substantially perpendicularly to the axis of the peg.

A further favourable embodiment is characterized in that the projection is constructed as a hollow sleeve the diameter of which, taken from the bottom of the sleeve, increase stepwise and which sleeve is sealed in the upright edge with its part having the smaller diameter. The sleeve is sealed in the upright edge by directing a gas flame to the bottom of the sleeve so that the sleeve sags into the glass. Since the gas-flame does not touch the glass surface of the upright edge, the glass surface during sealing remains smooth. This is of importance when during providing the luminescent phosphors on the display window the excess of phosphor suspension is poured out.

According to another embodiment the supporting element is cemented to the upright edge of the display window.

Again another embodiment is characterized in that the tube has a conical internal screening cap, which screening cap comprises a suspension element in each corner, which suspension element is connected to the supporting element connected in the upright edge of the display window. Usually an internal conical screening cap is used in display tube so as to screen the electron beams from the earth's magnetic field. The internal screening cap should be connected so that movements of the screening cap are not transferred to the resilient elements with which the colour selection electrode is suspended. This is effected by suspending the screening cap from the supporting element which is fixedly connected in the upright edge of the display window.

A further other embodiment is characterized in that the suspension element comprises a portion extending parallel to the strip-shaped resilient element, which portion extends at a distance smaller than the thickness of the peg of the strip-shaped resilient element. As a result of this it is prevented that the pegs work loose from the apertures in the supporting elements without it being necessary for the peg itself to comprise a locking hook.

Still a further other embodiment is characterized in that the suspension element comprises an aperture and that the strip-shaped resilient element at its end remote from the colour selection electrode has a pin which extends substantially parallel to the upright edge of the display window, said pin extending through the aperture in the suspension element. The pin which can make a small stroke in the aperture of the suspension element in the corner of the screening cap prevents the pegs from working loose from the apertures in the supporting elements in the case of shocks of the display tube.

BRIEF DESCRIPTION OF THE DRAWING

The invention will now be described in greater detail, by way of example, with reference to the accompanying drawing, of which.

DESCRIPTION OF THE PREFERRED EMBODIMENTS

Figure 1:
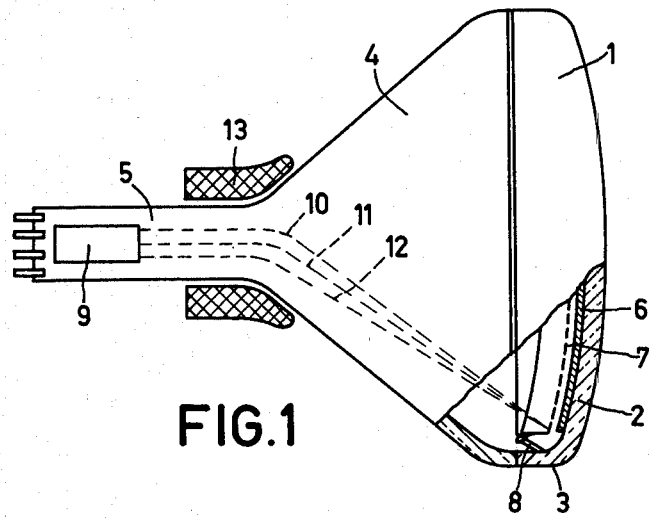
FIG. 1 is a partial sectional view of a colour display tube according to the invention.

The colour display tube according to the invention shown in FIG. 1 is formed by a glass envelope 1 which has a substantially rectangular display window 2 which comprises an upright edge 3, a cone 4 and a neck 5. A pattern of phosphors 6 luminescing in the colours red, green and blue is provided on the display window 2. At a short distance from the display window 2 a colour selection electrode 7 having a large number of apertures is connected by means of suspensions 8 shown diagrammatically. An electron gun 9 for generating three electron beams 10, 11 and 12 mounted is the neck 4 of the tube. These beams are deflected by means of a system deflections coils 13 placed around the tube and intersect each other substantially at the area of the colour selection electrode 7, after which each of the electron beams impinges on one of the three phosphors provided on the display window.

Figure 2:
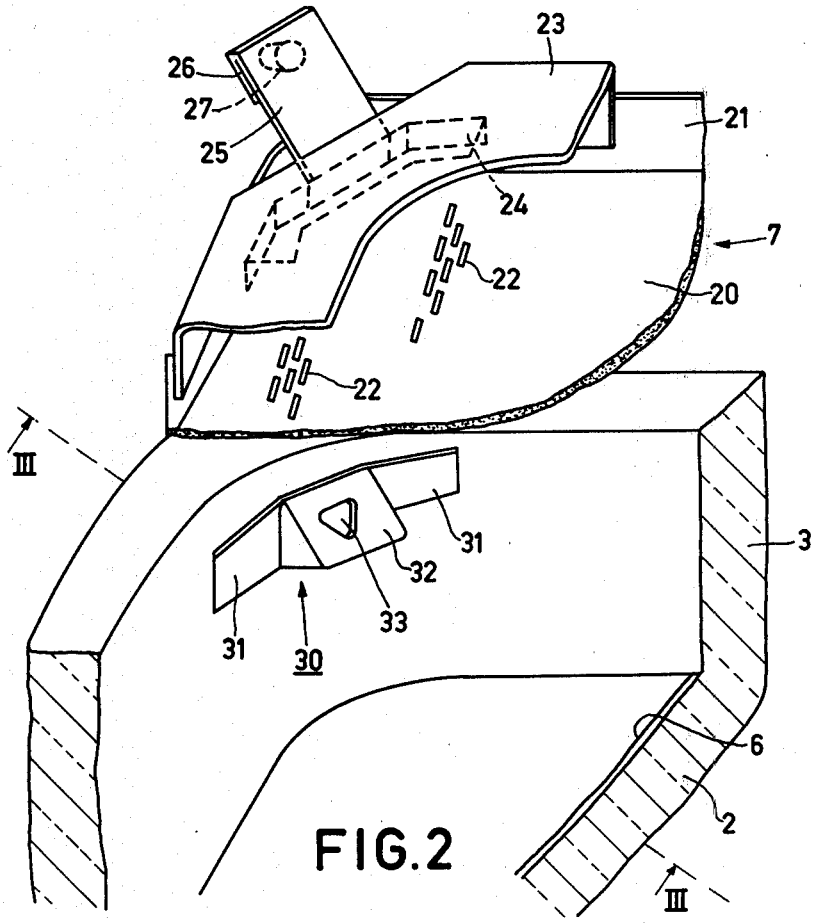
FIG. 2 is an exploded perspective view of a corner of the display window.

FIG. 2 is an exploded perspective view of a corner of the display window. The colour selection electrode 7 is constituted by a thin mask sheet 20 which has a large number of apertures 22 and comprising an upright edge 21. A mask ring 23 is connected to the upright edge 21 and also forms a diaphragm to prevent electron reflections at the upright edge 21. In order to prevent differences in expansion between the mask sheet 20 and the mask ring 23, both are manufactured from the same material and in approximately the same thickness. A supporting strip 24 to which a strip-shaped resilient element 25 is connected, is connected in the corner of the mask ring 23. At the end of the resilient element 25 remote from the colour selection electrode a plate 26 is connected which has a conical peg 27 which is shown in broken lines in the figure. The peg 27 is perpendicular to the plane of the resilient element 25. A supporting element 30 having two projections 31 is sealed in the corner of the upright edge 3 of the display window 2. The supporting element 30 comprises a portion 32 extending parallel to the resilient element 25 and having a triangular aperture 33. The colour selection electrode 7 is suspended in the display window 2 by placing the pegs 27 of the resilient elements 25 in the apertures 33.

Figure 3:
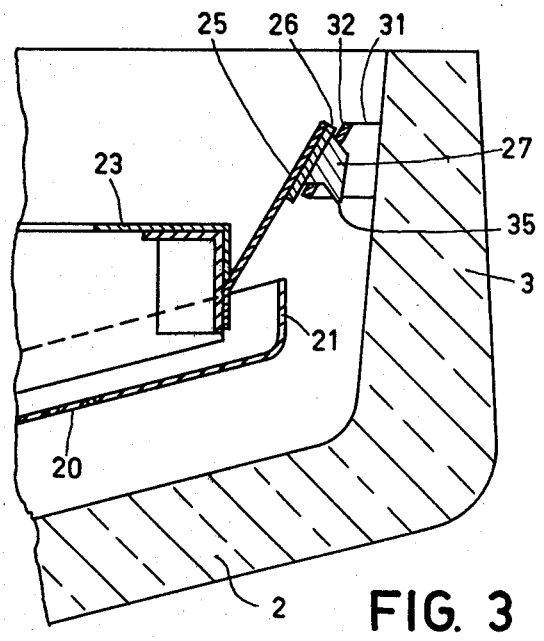
FIG. 3 is a sectional view taken on the line III—III of FIG. 2, FIGS. 4*a, b* and *c* show embodiments of supporting elements.

FIG. 3 is a sectional view taken on the line III—III of FIG. 2 with the colour selection electrode in the assembled condition. The resilient element 25 is connected to the colour selection electrode at such an angle that the resilient element 25 is substantially perpendicular to the electron beams deflected towards the corner of the display window. As a result of the resilience of the resilient elements 25 the colour selection electrode, in the case of expansion, moves in the direction towards the display window. When the colour selection electrode expands, a smaller distance is in fact necessary between the colour selection electrode and the display window to maintain a colour pure picture.

A locking hook 35 extending towards the colour selection electrode is connected to the end of the conical peg 27. The resilient elements 25 exert only a very small pressure on the supporting element 30. In the case of shocks of the tube perpendicularly to the display window 2 in a direction towards the display window 2, the forces exerted on the conical peg 27 are directed so that the conical peg 27 can work loose from the aperture 33 of the supporting element 30. The locking hook 35 prevents the working loose of the conical peg 27 from the aperture 33. In the case of shocks of the tube perpendicularly to the display window 2 in a direction away from the display window 2, the forces on the conical peg 27 are directed so that the conical peg 27 fixes itself in the aperture 33. Also in the case of shocks in directions parallel to the display window 2 the locking hook 35 prevents the conical peg 27 from working loose from the aperture 33. The function of the plate 26 which comprises the conical peg 27 is associated with the way of manufacture of the display window, which occurs as follows. The supporting elements 30 are sealed in the corners of the upright edge 3. A mask ring 23 having resilient elements 25 already connected in the corners is then provided in the display window 2 with the interposition of the plates 26 the conical pegs 27 of which are placed in the apertures 33 of the supporting elements 30. In this position the plates 26 are secured to the resilient elements 25. As a result of this it is effected that the position of the conical peg 27 corresponds accurately with the position of the aperture 33 in the supporting element 30. When the conical pegs 27 are provided directly on the resilient elements 27, deformations of the colour selection electrode may occur as a result of differences in the positions of the peg 27 and the aperture 33. In principle one resilient element may be provided with a plate having a peg. Two diagonally oppositely located resilient elements having a peg are placed on the relevant supporting elements. By using the resilience of the resilient elements the peg of the third resilient element is placed in the aperture of the third supporting element. The position of the peg of the fourth resilient element is thus fixed. By providing the peg on a separate plate, the position of the fourth peg can be brought in agreement with the position of the aperture in the fourth supporting element. In order to ensure that each time two diagonally oppositely located resilient elements engage the supporting elements at the same clamping pressure, a plate with peg should be provided on at least three resilient elements. For technical reasons of manufacture, a plate with a peg is preferably connected on all resilient elements.

After suspending the mask ring 23 with the resilient elements 25 in the display window 2 in the manner described above, the mask sheet 20 is laid in the display window with the interposition of a spacer jig, after which the mask ring 23 is welded to the upright edge 21 of the mask sheet 20.

Figures 4, 4A:
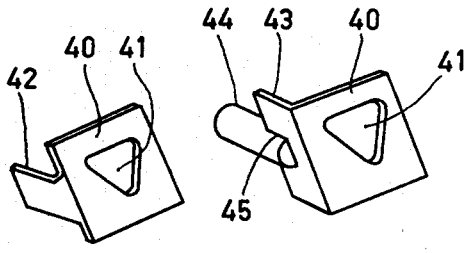
Figure 4C:
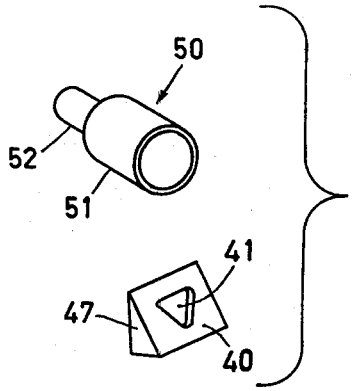

FIGS. 4*a, b* and *c* show a few other embodiments of supporting elements. In FIG. 4*a* the portion 40 having an aperture 41 is provided with a bent-over lug 42 which is sealed in the upright edge. In FIG. 4*b*, a peg 44 is first sealed in the upright edge. The peg 44 has a notch 45 in which the bent-over portion 43 of the part 40 is connected. In the embodiment shown in FIG. 4*c*, first a hollow sleeve 50 is sealed in the upright edge. The sleeve 50 comprises a portion 52 having a smaller diameter than the portion 51. A gas flame is directed in the sleeve 50 as a result of which the narrow portion 52 sags into the upright edge of the display window. The gas flame does not touch the glass surface so that the glass surface remains smooth. Herewith it is prevented that phosphor suspension remains in unevennesses of the glass after pouring out the excess of phosphor suspension. After sealing, the portion 40 with bent-over lugs 47 is connected to the sleeve 50.

In a display tube the electron beams are usually screened from the earth's magnetic field by means of a conical internal screening cap. The screening cap should be connected in the display tube in such manner that movement of the screening cap is not transferred to the resilient elements with which the colour selection electrode is suspended. A first embodiment with which this has been realized will be described in greater detail with reference to FIGS. 5*a* and 5*b*.

Figure 5A:
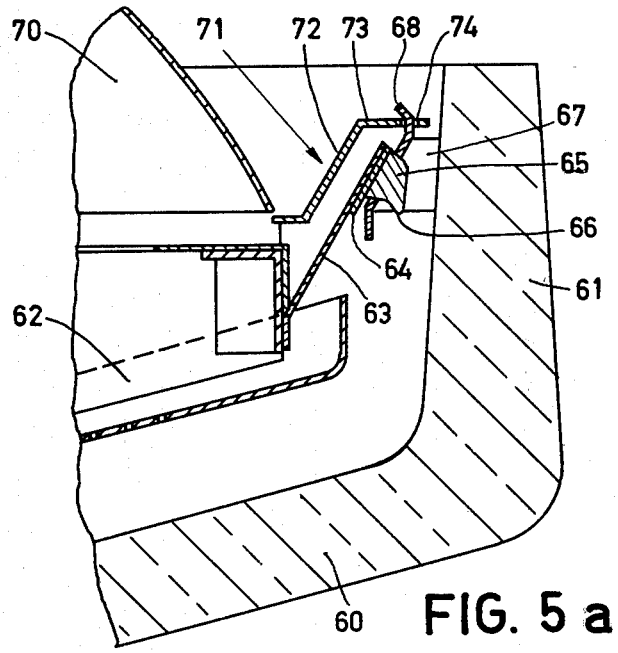
FIGS. 5*a* and 5*b* show a first embodiment of a suspension of a screening cap.

FIG. 5*a* is a sectional view taken on a diagonal of a corner of the display window. The colour selection electrode 62 is again suspended in the upright edge 61 of the display window 60 by means of resilient elements 63 which at their ends comprise a plate 64 having a peg 65. The peg 65 which has a locking hook 66 is connected in the supporting element 67. A suspension element 71 is connected in the corner of the conical screening cap 70. The suspension element 71 has a portion 72 extending substantially parallel to the resilient element 63 and a portion 73 extending substantially perpendicularly to the upright edge 61. The portion 73 has a slot-shaped aperture 74. The supporting element 67 comprises two projections 68. The screening cap 70 is connected by placing the suspension element 71 with the slot-shaped aperture 74 over the projections 68 and then bending the projections 68 in different directions.

Figure 5B:
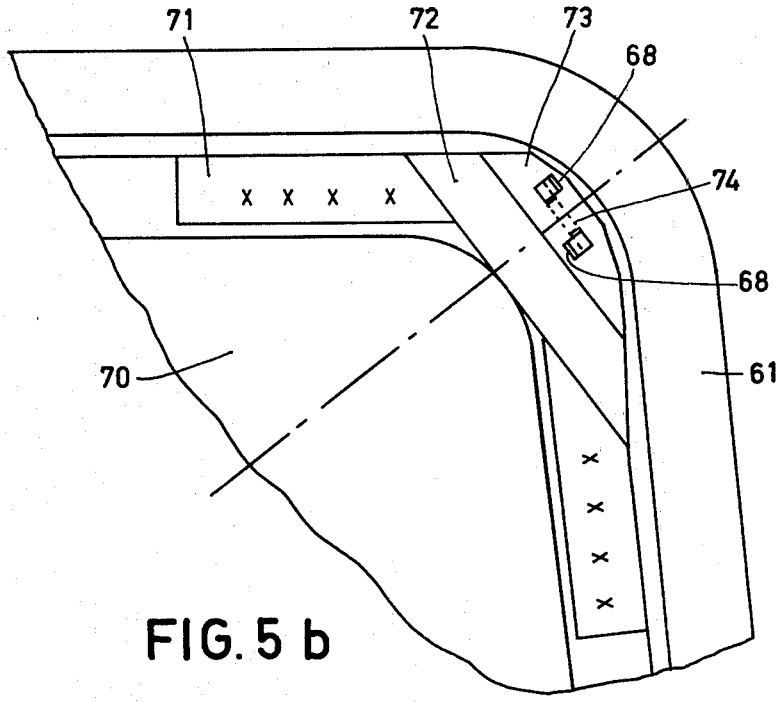

FIG. 5*b* is a plan view of the corner of the display window. As a result of the connection of the screening cap 70 to the supporting element 67 the forces occuring upon displacement of the screening cap 70 are not transferred to the resilient elements 63 so that the colour selection electrode 62 is not deformed.

Figure 6A:
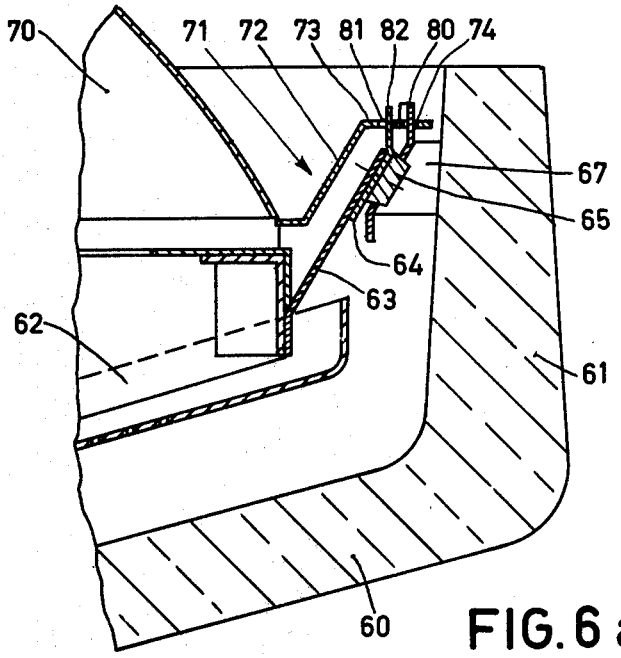
FIGS. 6*a* and 6*b* show a second embodiment of a suspension of a screening cap.
Figure 6B:
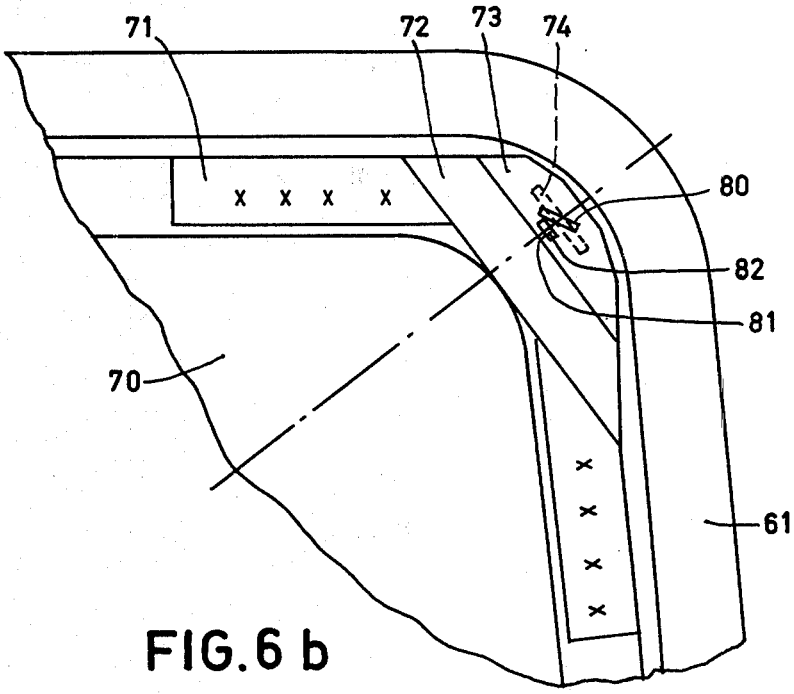

FIGS. 6*a* and 6*b* show a second embodiment of a connection of the screening cap in which the same components are referred to by the same reference numerals as in FIG. 5. The portion 73 again comprises a slot-shaped aperture 74. The supporting element 67 now comprises a T-shaped projection 80. The portion 73 of the suspension element 71 furthermore comprises an aperture 81. A pin 82 is connected to the plate 64. When the screening cap 70 is connected, the T-shaped projection 80 falls through the slot-shaped aperture 74 and the pin 82 falls through the aperture 81. The T-shaped projection 80 is then twisted. The pin 82 in the aperture 80 prevents the peg 65 from working loose from the supporting element 67 when shocks occur. In this case it is not necessary for the peg 65 to have a locking hook.

Figure 7A:
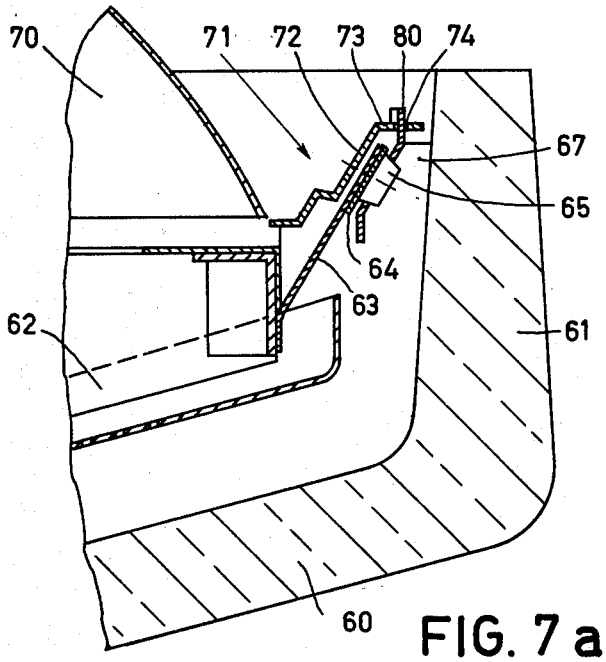
FIGS. 7*a* and 7*b* show a third embodiment of a suspension of a screening cap.
Figure 7B:
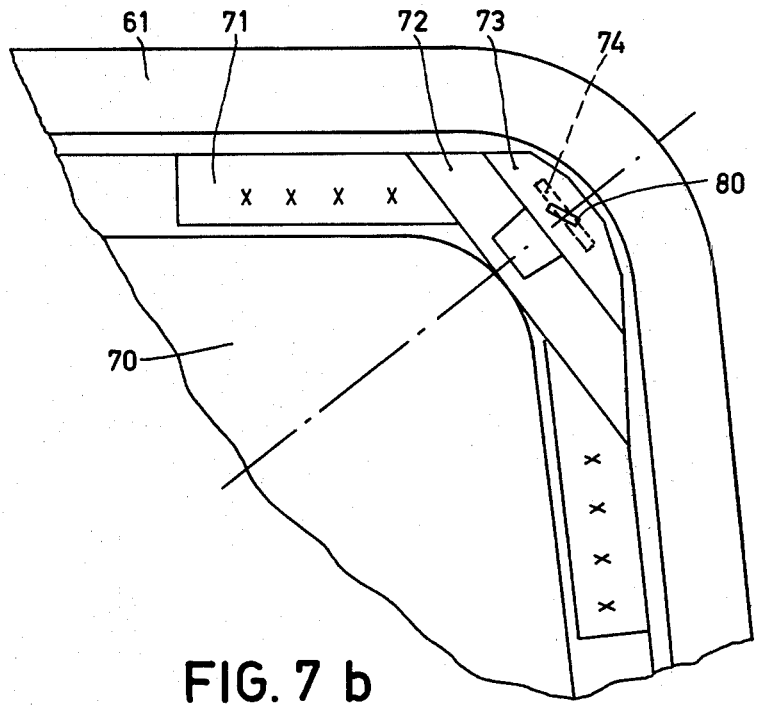

FIGS. 7*a* and 7*b* show a third embodiment of a connection of the screening cap in which the same components are referred to by the same reference numerals as in FIG. 6. The supporting element 67 again comprises a T-shaped projection 80 which falls through a slot-shaped aperture 74 in the suspension element 71. After connection of the screening cap 70 the T-shaped projection 80 is twisted. The portion 72 extending parallel to the resilient element 73 extends at a distance shorter than the thickness of the peg 65 of the resilient element 63. Herewith it is again prevented that the peg 65 can work loose from the supporting element 67. In this case also the peg 65 need not be provided with a locking hook.

What is claimed is:

1. A colour display tube comprising an envelope having a substantially rectangular display window provided with an upright edge and a substantially rectangular colour selection electrode having a large number of apertures, which electrode is suspended in the corners of the display window by means of a strip-shaped resilient element connected to each corner of the colour selection electrode, which resilient element is substantially perpendicular to the direction of an electron beam deflected toward the respective corner of the display window, said resilient element comprising a peg at its end remote from the colour selection electrode, characterized in that the axis of the peg extends substantially parallel to the direction of the electron beam directed toward the respective corner, said peg comprising a conical portion, and further characterized in that a supporting element is connected in the corner of the upright edge of the display window, said supporting element comprising a portion extending perpendicularly to the axis of the peg, said portion having an aperture through which the conical portion of the peg projects.

2. A colour display tube as claimed in claim 1, characterized in that the aperture in the supporting element is a triangular aperture.

3. A colour display tube as claimed in claim 1, characterized in that at its end remote from the strip-shaped resilient element the peg has a locking hook extending towards the colour selection electrode.

4. A colour display tube as claimed in claim 1, 2 or 3, characterized in that for at least one-strip-shaped resilient element the peg forms part of a metal plate which is connected to the end of the strip-shaped resilient element remote from the colour selection electrode.

5. A colour display tube as claimed in claim 1, 2, or 3 characterized in that the supporting element has at least one projection, which projection is sealed in the upright edge of the display window.

6. A colour display tube as claimed in claim 5, characterized in that the projection is constructed as a hollow sleeve having a diameter which increases stepwise, said sleeve having the smaller diameter portion sealed in the upright edge of the display window.

7. A colour display tube as claimed in claim 1, 2, or 3 characterized in that the supporting element is cemented to the upright edge of the display window.

8. A colour display tube as claimed in claims 1 to 2 or 3, characterized in that the tube has a conical internal screening cap having a suspension element in each corner, which suspension element is connected to the supporting element connected in the upright edge of the display window.

9. A colour display tube as claimed in claim 8, characterized in that the suspension element comprises a portion extending parallel to the strip-shaped resilient element, which portion extends at a distance smaller than the thickness of the peg of the strip-shaped resilient element.

10. A colour display tube as claimed in claim 8, characterized in that the suspension element comprises an aperture and that the strip-shaped resilient element at its end remote from the colour selection electrode has a pin extending substantially parallel to the upright edge of the display window, said pin extending through the aperture in the suspension element.

* * * * *